US005863189A

United States Patent [19]

Sundberg et al.

[11] Patent Number: 5,863,189

[45] Date of Patent: Jan. 26, 1999

[54] VARIABLE DISPLACEMENT VANE PUMP ADJUSTABLE BY LOW ACTUATION LOADS

[75] Inventors: Jack G. Sundberg, Meriden, Conn.; Mihir C. Desai, Yorba Linda, Calif.; Raymond D. Zagranski, Somers, Conn.

[73] Assignee: Coltec Industries Inc, New York, N.Y.

[21] Appl. No.: 500,297

[22] Filed: Jul. 10, 1995

[51] Int. Cl.[6] ..... F01C 1/16

[52] U.S. Cl. ..... 418/16; 418/23

[58] Field of Search ..... 418/16, 23, 30, 418/31

[56] References Cited

U.S. PATENT DOCUMENTS

| | | | |
|---|---|---|---|
| 2,606,503 | 8/1952 | Shaw | 418/16 |
| 2,880,677 | 4/1959 | Grupen | 418/23 |
| 4,177,024 | 12/1979 | Löhn | 418/16 |
| 4,764,095 | 8/1988 | Fickelscher | 418/31 |

FOREIGN PATENT DOCUMENTS

| | | | |
|---|---|---|---|
| 219586 | 5/1958 | Australia | 418/30 |
| 454548 | 2/1949 | Canada | 418/16 |

*Primary Examiner*—Charles G. Freay
*Attorney, Agent, or Firm*—Howard S. Reiter

[57] ABSTRACT

Variable-displacement, single-acting vane pumps in which the cylindrical cam member is adjustably supported within an outer annular cam housing to enable the cam member to be adjustably-rotated relative to the housing to adjust the geometric center of the cam chamber relative to the center of the rotor member and thereby adjust the displacement capacity of the pump between zero-flow maximum flow values. The annular housing for the cam member comprises a roller bearing assembly between its inner race surface and the cylindrical outer surface of the cam member, which minimizes the friction when the cam member is rotated during adjustment and enables the adjustment to be actuated remotely, such as by means of a small motor gear assembly.

7 Claims, 2 Drawing Sheets

VARIABLE DISPLACEMENT VANE PUMP ADJUSTABLE BY LOW ACTUATION LOADS

BACKGROUND OF THE INVENTION

1. Field of the Invention

The present invention relates to single acting, variable displacement fluid pressure vane pumps, such as for aircraft use, incorporating means for balancing cam bearing load, minimizing clocking forces, reducing friction and actuation loads.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and system have been developed in order to overcome some of the deficiencies of gear pumps, and reference is made to the following U.S. patents for their disclosures of several such pumps and systems: U.S. Pat. Nos. 4,247,263; 4,354,809; 4,529,361 and 4,711,619. Reference is also made to copending application Ser. No. 08/114,253, filed Aug. 30, 1993, the disclosure of which is hereby incorporated herein.

Vane pumps comprise a rotor element machined with slots supporting radially-movable vane elements, mounted within a cam member and manifold having fluid inlet and outlet ports in the cam surface through which the fluid is fed to the low pressure inlet areas or buckets of the rotor surface for rotation, compression and discharge from the high pressure outlet areas or buckets of the rotor surface as pressurized fluid.

Vane pumps that are required to operate at high speeds and pressures preferably employ hydrostatically (pressure balanced) vanes for minimizing frictional wear. Such pumps may also include rounded vane tips to reduce vane-to-cam surface stresses. Examples of vane pumps having pressure-balanced vanes which are also adapted to provide undervane pumping, may be found in the aforementioned copending application and in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with a seal arc.

Variable displacement vane pumps contain a cam element which is adjustable relative to the rotor element, about a pivot point which is external to the cam chamber, in order to change the relative volumes of the inlet and outlet or discharge buckets and thereby vary the displacement capacity of the pump.

Among the problems encountered with single acting vane pumps with external cam adjustment pivots are the high actuation loads required to overcome the high friction cam sealing loads in order to move the cam member relative to the seals to adjust the displacement. Also, the external pivot support of the cam member results in high clocking loads or stresses on the cam member due to the differential bucket pressures on the externally-supported cam member.

SUMMARY OF THE INVENTION

The present invention relates to novel single acting, variable displacement vane pumps which have the durability, ruggedness and simplicity of conventional gear pumps, and the versatility and variable metering properties of vane pumps, while incorporating a novel integrated support structure for the adjustable cam member which locates the pivot point or center of rotation of the cylindrical cam member within the eccentric cam chamber thereof, to facilitate adjustment thereof while balancing the cam bearing load relative to the rotor member and minimizing the clocking forces.

The novel pumps of the present invention comprise a durable, substantially uniform-diameter rotor member which is machined from barstock, in manner and appearance similar to the main pumping gear of a gear pump, so as to have large diameter journal ends at each side of a central vane section comprising a plurality of axially-elongated radial vane slots, well areas of each vane slot slidably-engaging a mating vane element as with prior known vane pumps, the adjustable narrow cam member having a continuous circular inner cam surface eccentrically surrounds and encloses the central vane section, and the cam surface is engaged by the outer surfaces or tips of the vane elements during operating of the pump. The journal ends of the rotor member are rotatably-supported within opposed durable bearing seal assemblies, which have faces which seal against the outer annular sleeve housing. During rotation of the journals of the vaned rotor member within the bearings and of the central vane section of the rotor member within the cam member, fluid such as liquid fuel is admitted at low pressure to the inlet arc segment of the cam chamber, through inlet passages at the interfaces of the cam member and each of the seal assemblies, and into expanding inlet bucket chambers between the vanes, and also through the vane slot extensions to under-vane chambers. Continued rotation of the rotor member through a sealing arc segment into a discharge arc segment reduces the volume of the bucket areas and changes the pressure acting upon the leading face of each vane from low inlet pressure to increasing discharge pressure at the volume of each bucket chamber is gradually compressed at the discharge side or arc of the eccentric cam chamber. The pressurized fuel escapes through discharge passages in each seal and bearing, and is channelled to its desired destination.

The undervane and overvane pressures acting upon the vanes are balanced so that the vanes are lightly loaded or "floated" throughout the operating of the present pumps. This reduces wear on the vanes and, most importantly, provides elasto-hydrodynamic lubrication of the interface of the vane tips and the continuous cam surface. Such balancing is made possible by venting the undervane slot areas to an intermediate fluid pressure in the seal arc segments of the seal bearings assemblies whereby, as each vane is rotated from the low pressure inlet segment to the high pressure discharge segment, and vice versa, the pressure in the undervane slot areas is automatically regulated to an intermediate pressure at the seal arc segments, whereby the undervane and overvane pressures are balanced which prevents the vane elements from being either urged against the cam surface with excessive force or from losing contact with the cam surface.

The novel vane pumps of the present invention also provide substantial undervane pumping of the fluid from the undervane slot areas by piston action as the vanes are depressed into the slots at the discharge side of the cam chamber. Such undervane pumping can contribute up to 40% or more of the total fluid displacement.

The essential novelty of the vane pumps of the present invention resides in the support structure for the cylindrical cam member whereby the cam member is adjustably supported within an outer annular sleeve housing to enable the cam member to be adjustably-rotated relative to the housing to adjust the geometric center of the cam chamber relative to the center of the rotor member and thereby adjust the displacement capacity of the pump between zero-flow and maximum flow values.

According to a preferred embodiment of the invention, the annular sleeve housing for the cam member comprises a roller bearing assembly between an outer housing sleeve and the cylindrical outer surface of the cam member, which minimizes the friction when the cam member is rotated during adjustment and enables the adjustment to be actuated remotely by means of a small motor gear assembly.

DETAILED DESCRIPTION

Figure 2:
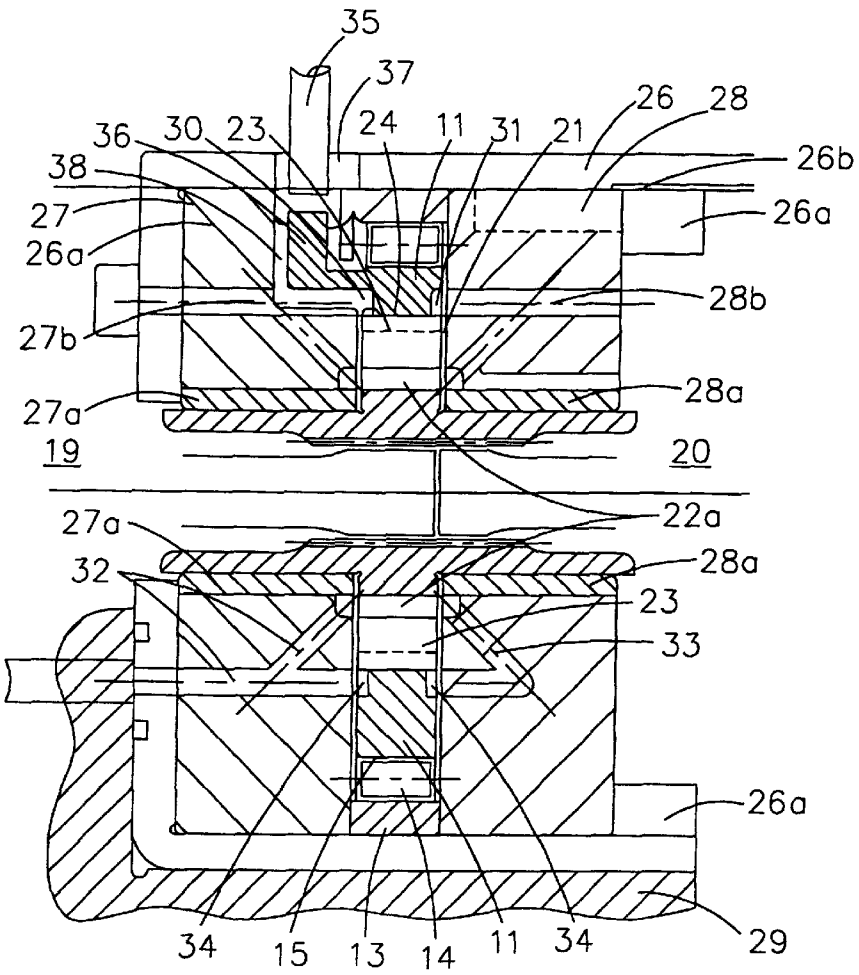
FIG. 2 is a cross-sectional view of the pump of FIG. 1 taken along the line 2—2 thereof.
Figure 1:
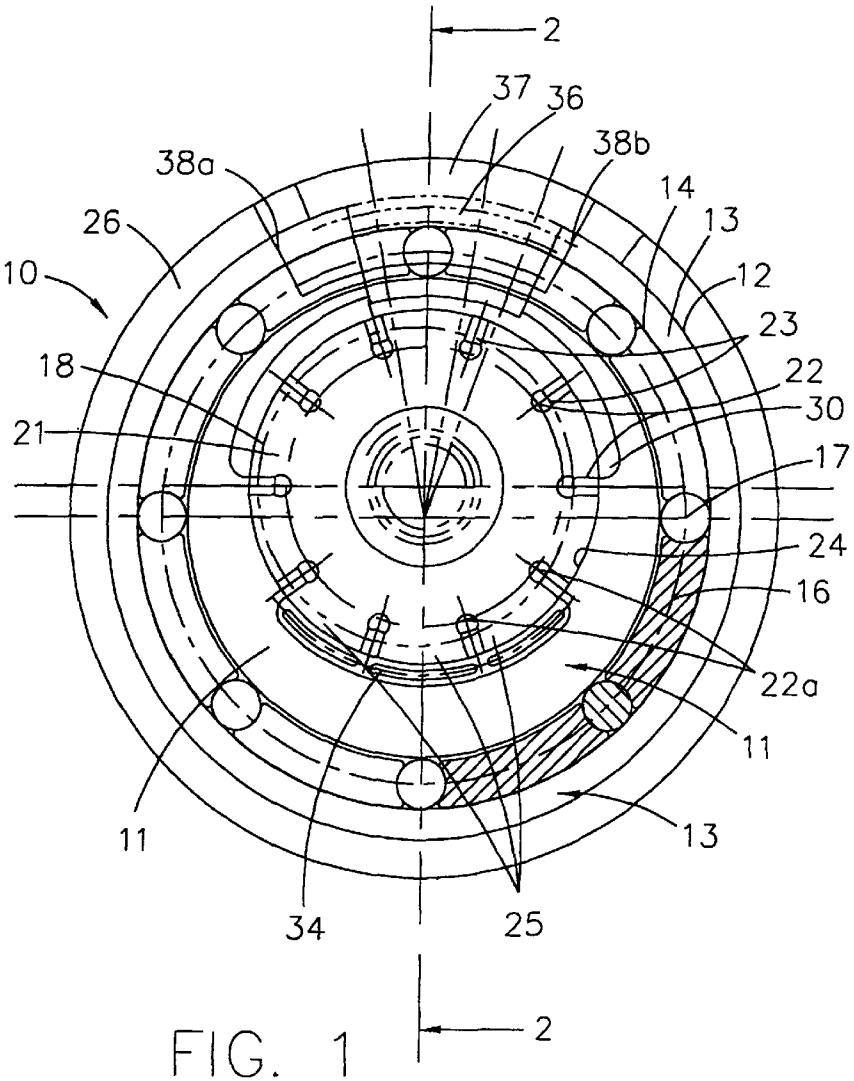
FIG. 1 is a cross-sectional view of a minimum friction actuation variable displacement vane pump according to one embodiment of the present invention.

Referring to the embodiment of FIGS. 1 and 2 of the drawings, the pump 10 thereof is designed to support the cam member 11 within an annular cam housing 12 comprising an outer annular race section 13 which is slightly larger in width, i.e., between 0.0002" larger, than the width of the cam housing 12, and an annular roller bearing assembly 14, the outer surface 15 of the cam member 11 functioning as an inner race for the roller bearing assembly 14. The assembly 14 comprises a cage member 16 for evenly-spaced roller bearings 17 which engage between the cam race surface 15 and the outer race surface 13 to minimize frictional engagement therewith and permit relative rotation of the cam member 11 upon the application of a minimum actuation force to adjust the displacement of the pump between minimum and maximum values.

The pump 10 further comprises a rotor member 18 having opposed journals 19 and 20 and a central vane section 21 of increased diameter provided with a plurality of uniformly spaced radially-extending vane slots 22, each of which is provided with a vane element 23 which is slightly smaller in thickness and similar in length to the width and length of its vane slot 22 to permit radial movement therewithin into engagement with the inner surface 24 of the cam member 11. The eccentric or off-center adjustment of the cam member, 11 relative to the center of rotation of the rotor, member which has a smaller diameter than that of the central cam opening, defined by the cylindrical inner cam surface 24, creates a variable eccentric cam chamber therebetween. The extension of the vane elements 23 from the slots 22 into frictional engagement with the cam surface 24 partitions the cam chamber into a plurality of vane bucket sections 25, the volumes or capacities of which are sequentially increased and decreased during pump operation. The pump 10 is illustrated at substantially maximum displacement in FIG. 1. Adjustment to reduced or zero displacement is accomplished by counter-clockwise rotation of the cam member 11 to reduce the different between the center of the cam chamber and the center of rotation of the rotor member 18 whereby the difference between the volumes of the vane bucket sections 25 is reduced or eliminated (zero flow).

In the embodiment of FIGS. 1 and 2, the pump 10 is housed within an outer cartridge 26 which confines the pump between opposed annular seal bearing members 27 and 28 within the main housing 29 of the engine served by the pump. The pump is secured within the cartridge 26 by means of an end nut 26*a* which threadably engages the threaded open end 26*b* of the cartridge. The nut 26*a* clamps the outer race section 13 between the bearing members 27 and 28 without applying any clamping force against the cam housing 12, which is from 0.0002" to 0.0004" thinner than the race section 13. This leaves the cam member free to turn on the roller bearings 17. This limits the pump leakage to the roller cage area due to the resulting small clearance between the cam faces and the adjacent faces of the bearing members 27 and 28. The rollers and the cam housing 12 are matched in width which limits leakage to the inlet arc area of the pump. This design allows the pump assembly to operate as an anti-friction adjustable roller bearing. The seal bearing members 27 and 28 comprise durable sleeve bearings 27*a* and 28*a* which sealingly engage the rotor journals 19 and 20 while permitting free rotation of the rotor member 18 for operation of the pump. The seal bearing members 27 and 28 are also provided with fluid inlet passages 27*b* and 28*b* which open to cam face recesses 30 and 31, respectively, to supply liquid, such as fuel, to the expanding vane bucket sections 25 in the low pressure inlet arc of the pump.

The seal bearing members 27 and 28 also comprise fluid discharge or outlet passages 32 and 33 in the discharge arc of the pump which are open to the undervane areas 22*a* of the vane slots 22 and to the contracting vane bucket areas through cam outlet ports 34, in the high pressure discharge arc of the pump.

The cam member 11 of the embodiment of FIGS. 1 and 2 is movable, to adjust the fluid displacement of the pump, by engagement between a motor-actuated gear wheel 35, FIG. 2, and the teeth on a cam lever arm 36, through an opening 37 in the outer cartridge 26. The arm 36 extends through a cut-out arcuate passage 38 in the bearing housing 27 and is adjustable between passage walls 38*a* and 38*b* which define minimum and maximum displacement adjustment stops, respectively.

The roller bearing support of the cam member substantially eliminates friction during actuation of the cam lever arm 36, whereby small motors or solenoids can be incorporated as actuation members, such as for use on helicopter fuel systems.

Figure 3:
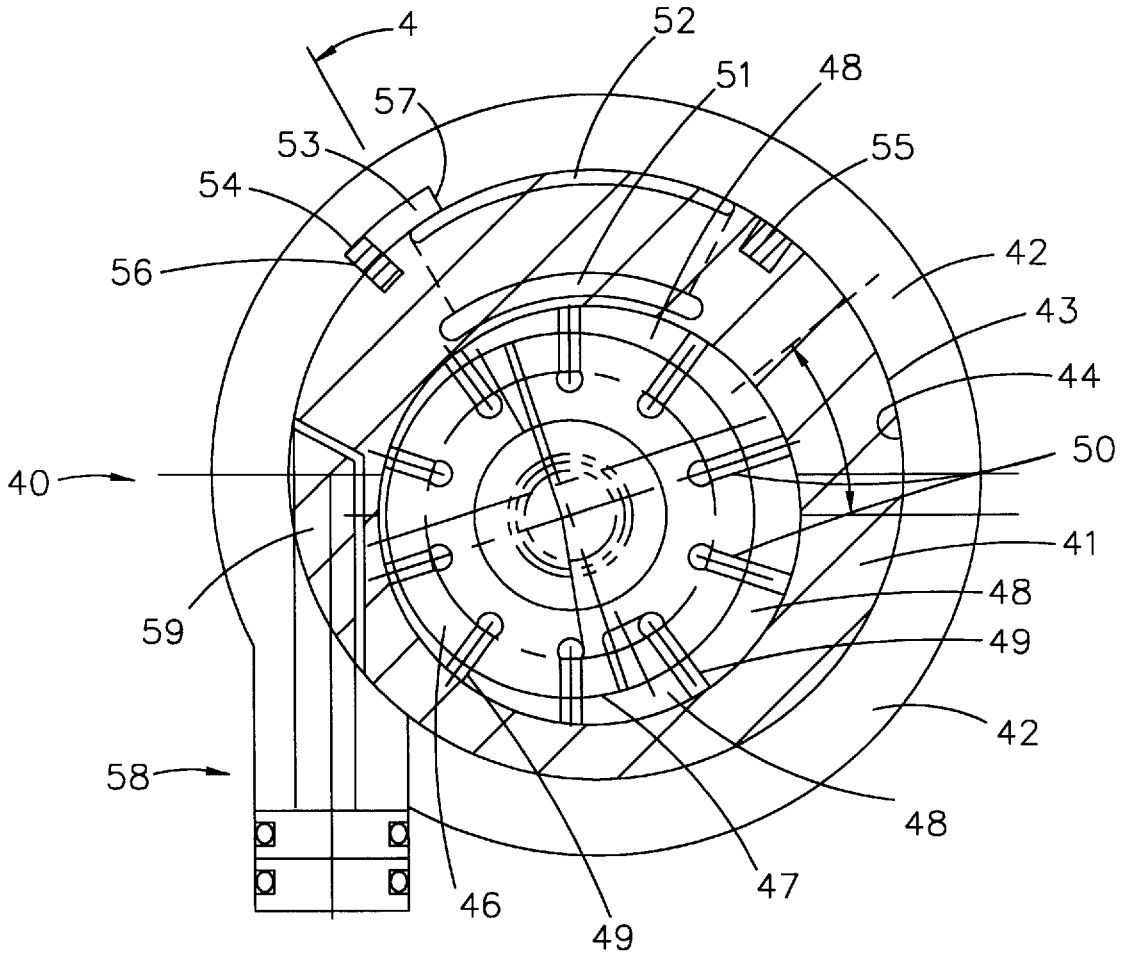
FIG. 3 is a cross-sectional view of a variable displacement vane pump having a reduced actuation load, a balanced cam-bearing load and a simplified actuation system, according to another embodiment of the present invention.
Figure 4:
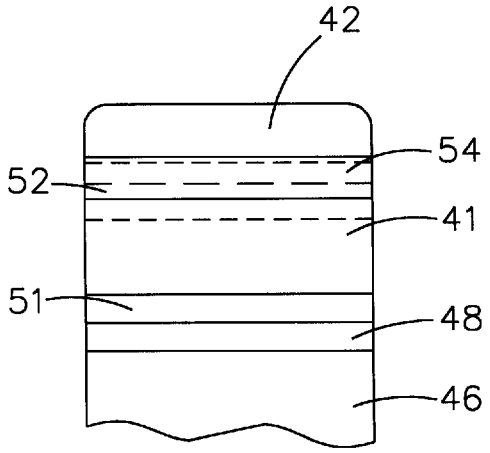
FIG. 4 is a view taken along the line 4—4 of FIG. 3, illustrating the extension of the seal member into a pressure recess in the outer sleeve housing to pressure-bias the cam member to maximum displacement position.

In the embodiment illustrated by FIGS. 3 and 4 of the drawings, the pump 40 thereof comprises a cam member 41 rotatably supported within an outer bearing housing 42 for adjustment between maximum displacement position, shown in FIG. 3, and minimum or zero displacement position. The cam member 41 has an outer smooth cylindrical surface 43 which engages the smooth cylindrical inner surface 44 of the housing 42 to enable relative rotation therebetween during adjustment of the displacement capacity of the pump.

The inner cylindrical surface 45 of the cam member defines the cam chamber within which the smaller diameter rotor member 46 rotates during operation of the pump. The axis of rotation of the rotor member 46 is eccentric to the center of the cam chamber to provide between the rotor surface 47 and the cam surface 45 a plurality of variable capacity vane bucket areas 48 separated by vane elements 49 radially-movable within vane slots 50 in the rotor member 46.

As with the embodiment of FIGS. 1 and 2, the pivot point or center of rotation of the cam member 41 is located within the cam chamber, rather than external thereto, as in prior known variable displacement pumps. In both cases, this substantially eliminates clocking loads since the pressure load acts through the center of rotation of the cam, or nearly so, as opposed to acting through an external pivot point. Also bearing loads are minimized as compared to prior known pumps in which adjustments to the cam member are resisted by the frictional engagement between the seals and the cam faces.

During operation of pump 40, the rotor member 46 rotates counter-clockwise as liquid is supplied to the lower expanding vane buckets 48 in the low pressure inlet arc of the pump. The buckets are moved through a sealing arc and then are contracted in the upper high pressure discharge arc to discharge liquid under high pressure through cam passages 51 to the desired destination. Also the high pressure liquid is communicated to an arcuate recess 52 in the outer cam surface 43 to pressurize the recess 52 and also the arcuate chamber 53 in the inner cylindrical surface 44 of the bearing housing 42. The outer surface 43 of the cam member is provided with a spaced pair of seal members 54 and 55 recessed into the surface thereof. Seal member 54 extends into engagement with the upper surface of the chamber 53 and functions as a piston to bias the cam member into maximum displacement position when the chamber 53 is pressurized. In such position, the seal member 54 is forced against chamber wall 56 as a maximum displacement stop member. Adjustment of the cam member 41 to a minimum or zero displacement position requires that the cam member be forced into clockwise rotation to move the seal member 54 through the arcuate bearing chamber 53 towards or against the other chamber wall 57 for reduced or zero displacement, as desired.

In the embodiment shown in FIG. 3, actuation of the cam member in the clockwise direction is produced by means of a piston assembly 58 such as a pneumatic piston assembly having a piston rod 59 which is extendable into engagement with the cam member 41 to cause rotation thereof when the assembly 58 is pressurized to reduce the displacement capacity of the pump. When the assembly 58 is depressurized, the cam member 41 is reverse-rotated by pressurization of the cam recess 52 during operation of the pump.

What is claimed is:

1. A durable vane pump comprising:

(a) a cylindrical rotor member having journal ends and a central vane section comprising a plurality of radial vane slots uniformly spaced around the central circumference thereof, said vane slots being elongate in the axial direction and each having a vane-supporting portion;

(b) a plurality of vane elements, each slidably-engaged within the vane-supporting portion of a said vane slot for radial movement therewithin;

(c) a unitary cam member having a cylindrical outer surface, opposed, parallel, flat faces and a bore therethrough forming a cam chamber having a continuous cylindrical interior cam surface, the central vane section of said rotor member being supported axially and non-concentrically within said cam chamber so that the outer tip surfaces of all of the vane elements make contact with said continuous interior cam surface during rotation of said rotor member between a low pressure fuel inlet arc segment and a high pressure fuel outlet arc segment of said cam chamber;

(d) an outer annular cam housing having a cylindrical inner surface comprising an annular roller bearing assembly having a width matched to the width of said cam housing and which engages and rotatably supports the cylindrical outer surface of said cam member for adjustment of the location of the axis of the cam chamber relative to the axis of rotation of said rotor member, to adjust the displacement capacity of said pump;

(e) an opposed pair of seal bearing members, each having a face which sealingly engages a face of said outer annular cam housing and which is closely spaced from a face of said cam member, said seal bearing members rotatably supporting the journal ends of said rotor member for rotation of the central vane section of the rotor member within said cam chamber.

2. A vane pump according to claim 1 in which the inner surface of said annular cam housing for the cam member comprises an annular bearing race surface and said annular roller bearing assembly is engaged between the cam housing race surface and the outer surface of the cam member to reduce friction and facilitate rotation of said cam member relative to said cam housing.

3. A vane pump according to claim 1 which further comprises a cam member adjustment means for rotating said cam member, and adjustment-limit means for regulating the rotation of the cam member between one stop means, representative of maximum pump displacement, and an opposed stop means, representative of minimum or zero pump displacement.

4. A vane pump according to claim 3 in which said cam member adjustment means comprises an extension arm integral with said cam member and accessible through one of said seal bearing members to adjustably rotate the cam member and change the displacement capacity of the pump.

5. A vane pump according to claim 4 in which said extension arm terminates in a gear tooth segment which is engageable by a motor-driven gear for the automatic adjustment of the displacement capacity of the vane pump.

6. A vane pump according to claim 3 in which said cam member adjustment means comprises a fluid actuating means having a housing attached to said outer annular cam housing and a fluid-driven piston member which is extendable through said outer cam housing to rotate said cam member and adjust the displacement capacity of the pump.

7. A vane pump according to claim 1 comprising an outer cylindrical housing enclosing said vane pump between an annularly flanged end wall thereof and an open end thereof, and a nut member threadably engaging the open end of said cylindrical housing and adjustable to clamp said seal bearing members against said cam housing while leaving the cam member freely adjustable relative to the cam housing.

* * * * *